US012134455B2

(12) United States Patent
Bermudez Miquel et al.

(10) Patent No.: US 12,134,455 B2
(45) Date of Patent: Nov. 5, 2024

(54) PROPULSION SYSTEM FOR VESSELS

(71) Applicant: BOUND4BLUE, SL, Barcelona (ES)

(72) Inventors: Jose Miguel Bermudez Miquel, Barcelona (ES); Cristina Aleixendri Munoz, Barcelona (ES); David Ferrer Desclaux, Barcelona (ES); Ignacio Bermudez Sanchez, Barcelona (ES); Manuel Jesus Gonzalez Garcia, Barcelona (ES); Ulises Fernandez Martinez, Barcelona (ES); Oriol Sanchez Garcia, Barcelona (ES)

(73) Assignee: BOUND4BLUE, SL, Barcelona (ES)

( * ) Notice: Subject to any disclaimer, the term of this patent is extended or adjusted under 35 U.S.C. 154(b) by 513 days.

(21) Appl. No.: 17/442,852

(22) PCT Filed: Mar. 25, 2020

(86) PCT No.: PCT/ES2020/070203
§ 371 (c)(1),
(2) Date: Sep. 24, 2021

(87) PCT Pub. No.: WO2020/193835
PCT Pub. Date: Oct. 1, 2020

(65) Prior Publication Data

US 2022/0177097 A1 Jun. 9, 2022

(30) Foreign Application Priority Data

Mar. 26, 2019 (ES) ..... ES201930271

(51) Int. Cl.
*B63H 9/061* (2020.01)
*B63B 79/10* (2020.01)
*B63B 79/40* (2020.01)

(52) U.S. Cl.
CPC ..... *B63H 9/061* (2020.02); *B63B 79/10* (2020.01); *B63B 79/40* (2020.01)

(58) Field of Classification Search
CPC .. B63H 9/00; B63H 9/06; B63H 9/061; B63B 79/00; B63B 79/10; B63B 79/40
(Continued)

(56) References Cited

U.S. PATENT DOCUMENTS

| | | | | |
|---|---|---|---|---|
| 4,602,584 | A * | 7/1986 | North | B63H 9/02 114/39.3 |
| 9,540,087 | B2 * | 1/2017 | Winkler | B63H 9/02 |
| 11,142,294 | B2 * | 10/2021 | Malpede | B63H 9/04 |

FOREIGN PATENT DOCUMENTS

| | | |
|---|---|---|
| EP | 3235719 | 10/2017 |
| FR | 2847009 | 5/2004 |

(Continued)

OTHER PUBLICATIONS

International Search Report and Written Opinion for PCT/ES2020/070203 mailed on Jul. 14, 2020.

(Continued)

*Primary Examiner* — Lars A Olson
(74) *Attorney, Agent, or Firm* — Kutak Rock LLP

(57) ABSTRACT

The propulsion system for vessels comprises at least one suction sail (3), comprising the suction sail (3) a suction system (10) and a driving unit (8) for driving the rotation of said at least one suction sail (3), in which at least one suction sail (3) also comprises a plurality of sensors (12, 13, 14, 15) connected to a control unit (9), whose control unit determines the operation of the suction system (10) and the transmission unit (8).
It permits to provide a propulsion system for vessels that permits to optimize their performance using suction sails.

10 Claims, 10 Drawing Sheets

(58) Field of Classification Search
USPC ..... 114/102.16
See application file for complete search history.

(56) References Cited

FOREIGN PATENT DOCUMENTS

| | | |
|---|---|---|
| NL | 2006560 | 10/2012 |
| WO | 2018211260 | 11/2018 |
| WO | 2020193835 | 10/2020 |

OTHER PUBLICATIONS

Designers in Action Tube Sail Drives Costeau's Experimental Boat a Cleaner Calypso; 903 Machine Design; vol. 55 p. 102-103, Oct. 1983; Cleveland, Ohio, USA.

* cited by examiner

PROPULSION SYSTEM FOR VESSELS

This is the United States National Stage of Patent Cooperation Treaty Application No. PCT/ES2020/070203, filed Mar. 25, 2020, which claims priority to Spanish Patent Application No. ES201930271A, filed on Mar. 26, 2019, the disclosures of which are incorporated herein by reference in their entireties.

The present invention concerns a propulsion system for vessels, in particular, a propulsion system for vessels comprising one or more suction sails.

BACKGROUND OF THE INVENTION

The use of propulsion systems for vessels called wind propulsion systems (WAPS) is known, and their performance is related to the aerodynamic forces (lift) they can produce.

These forces are directly related to the aerodynamic characteristics of the system, such as its aerodynamic coefficients, to the surface of the system and to the wind speed present.

The lift coefficient depends on two main variables: the geometry of the aerodynamic profile (asymmetric vs. symmetric) and the attack angle (defined as the angle between the profile chord and the direction of the airflow).

The first variable is the shape of the aerodynamic profile. A symmetrical profile has its axis of colinear symmetry with the chord of the profile itself. This type of profile has a zero lift coefficient when the attack angle is zero, since it does not produce any asymmetry in the airflow around it and, therefore, no pressure differential.

Adding asymmetries in the aerodynamic profile can generate pressure differences in the airflow around the profile, thus producing higher lift coefficients. However, these asymmetries are hardly applicable in WAPS, as they must be able to operate for any wind direction.

The main limitation when implementing asymmetric profiles to increase the lift coefficient lies in the high complexity of the mechanical systems of the WAPS, which results in high costs and greater weight.

The second variable is the attack angle, which behaves as follows: for an attack angle equal to zero, the airflow flows around the aerodynamic profile with virtually no turbulence, and consequently the lift is almost zero.

As the attack angle increases, the lift coefficient increases in a linear fashion. At the same time, turbulence appears starting from the trailing edge.

There is a maximum lift attack angle, for which turbulence and its effects are relevant.

Finally, above the attack angle of maximum sustenance occurs the effect known as stall. This phenomenon is a sudden detachment of the airflow attached to the profile, which causes an abrupt reduction in lift.

In this case, the limitation of the maximum lift coefficient is related to the sudden detachment of the flow boundary layer, the loss.

Within wind propulsion systems (WAPS) the use of rigid suction sails is known. The objective of the rigid suction sail is to maximize the lift coefficient by controlling the effects induced by the two variables described above.

Starting with the attack angle, if the detachment of the boundary layer around the profile can be delayed with respect to the attack angle, higher lift coefficients can be obtained. This could be achieved by suctioning the airflow from the top of the profile, ensuring that it remains attached to the sail surface for high angles of attack. This process is described in detail below:

When the original attack angle of maximum lift is reached (without suction), part of the airflow of the extrados is sucked in.

The suction adheres the boundary layer to the profile, delaying the stall, although it increases the attack angle, which implies an increase in the lift coefficient.

Due to the suction of the flow, the detachment point remains approximately constant as the attack angle (and therefore the attack angle) increases. As a consequence, behind that point of flow release, the structure and shape of the profile is not necessary and can be eliminated, reducing the size of the profile.

Finally, as the detachment is controlled by suction, the shape of the profile can be modified by introducing significant asymmetry. The best solution to achieve this effect is through a "moving trailing edge", called flap. This flap can be positioned in two different positions (one on each side of the aerodynamic profile chord) generating the asymmetry towards one side or the other, to adapt to any wind direction.

The rigid suction sail has a substantial improvement over the rigid passive sail: it increases the lift coefficient of the sail, which improves the efficiency of the rigid sail in terms of thrust per unit area of the sail. These improvements have a number of advantages:

The higher the lift coefficient, the smaller the size of the rigid sails needed to provide the same thrust and therefore the same fuel economy.

Size reduction means less expenditure on materials for the structure, shorter production times per unit, which translates into lower production costs.

The reduction in size and material used also reduces the weight of each unit, with a positive effect on the stability and storage capacity of the boat. It can be reduced by up to 50% in weight.

Smaller systems allow more units to be installed for the same available deck space, increasing the maximum potential reduction in fuel consumption for a single vessel.

Smaller systems also mean less impact on visibility requirements.

On the other hand, the rigid suction sail also offers certain limitations, most of them related to the suction system itself. The major limitations are:

Suction requires an active pump or a fan that constantly sucks in air. This results in constant power consumption to keep the system in operation. It is important to note that this power consumption is a very small fraction of the thrust power provided by the sail.

The region of the rigid sail surface where the boundary layer suction should be performed has a certain critical position, and it is very important to ensure that the rest of the rigid sail surface is sealed.

The performance of the rigid suction sail for headwinds is lower, as in this operating scenario the aerodynamic resistance gains a lot of relevance against the thrust.

Consequently, the rigid suction sail is suitable for vessels with the following characteristics:

Vessels with limited deck space.

Vessels with reduced stability.

Vessels with limited visibility.

Vessels with no prop limit, because it does not require a folding system.

Fishing vessels fit perfectly with these characteristics.

Therefore, an objective of the present invention is to provide a propulsion system for vessels that allows them to optimize their performance using suction sails.

DESCRIPTION OF THE INVENTION

With the propulsion system of the invention, the above-mentioned disadvantages are solved, presenting other advantages that will be described below.

The propulsion system for vessels according to the present invention comprises at least one suction sail, comprising said suction sail a suction system and a driving unit for driving the rotation of said at least one suction sail, wherein the at least one suction sail also comprises a plurality of sensors connected to a control unit, whose control unit determines the operation of the suction system and the driving unit.

Such an operation can be autonomous or semi-autonomous, i.e. with very little interaction with the crew.

Advantageously, such a plurality of sensors includes at least one wind sensor, at least one sensor for the rotation of the suction sail, at least one sensor for the position of a flap of the suction sail, and/or at least one suction sensor.

In addition, the control unit preferably includes a user interface for the user to interact with the control unit.

If desired, the propulsion system may also comprise a manual control unit connected to the suction system and to the driving unit for manual control of the propulsion system.

Advantageously, said suction sail comprises a rigid or flexible outer coating and a suction area provided with a plurality of holes.

Preferably, said driving unit is located at the lower end of the suction sail and is an electric or hydraulic driving unit, driven by a power unit.

This suction sail also includes a support structure at its lower end to support its weight and restrict lateral movement of the suction sail.

According to a possible embodiment, the lower part of the suction sail comprises a tilting support, which allows the suction sail to be tilted with respect to the vertical, i.e. it is tilted with respect to a substantially horizontal axis.

With the propulsion system for vessels according to the present invention, the operation of the suction sail can be optimized automatically, based on the data collected by said sensors.

When the suction system is a single fan or multiple fans, the suction can be adjusted along a suction zone to suit each zone.

A multiple suction zone can also be made, which causes a pressure gradient (and thus suction) to control the absorbed flow.

It allows the movement/positioning of the flap to be active (by means of a motor and gears, by cables) or passive (to be mechanically positioned on one side or the other depending on the (vertical) rotation of the suction sail.

BRIEF DESCRIPTION OF THE DRAWINGS

For a better understanding of what has been disclosed, some drawings are included in which, schematically and only as a non-limitative example, a practical case of embodiment is shown.

DESCRIPTION OF PREFERRED EMBODIMENTS

Figure 1:
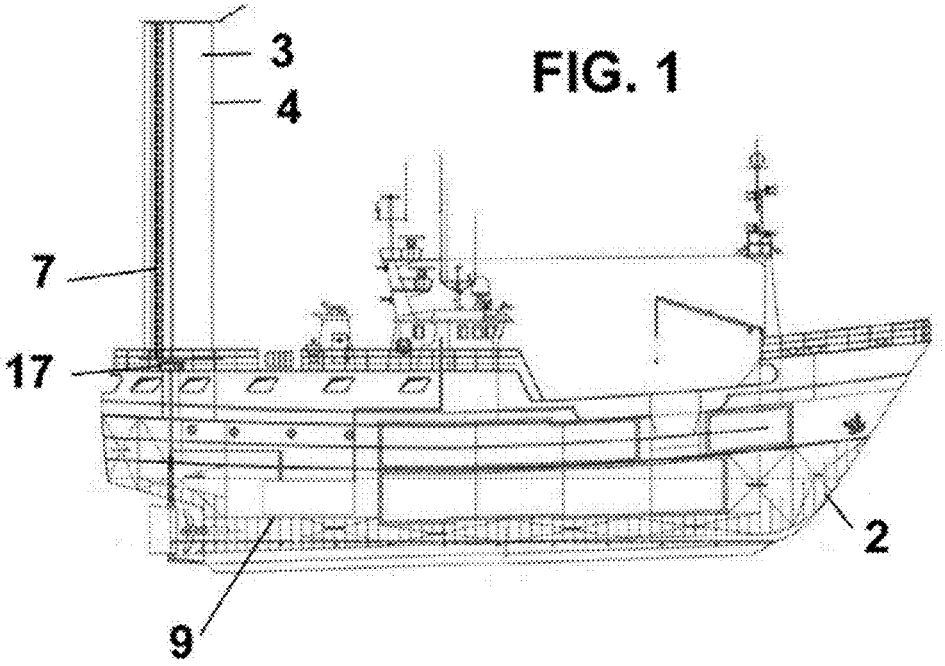
FIG. 1 is a side elevation view of a vessel incorporating the propulsion system according to the present invention.
Figure 2:
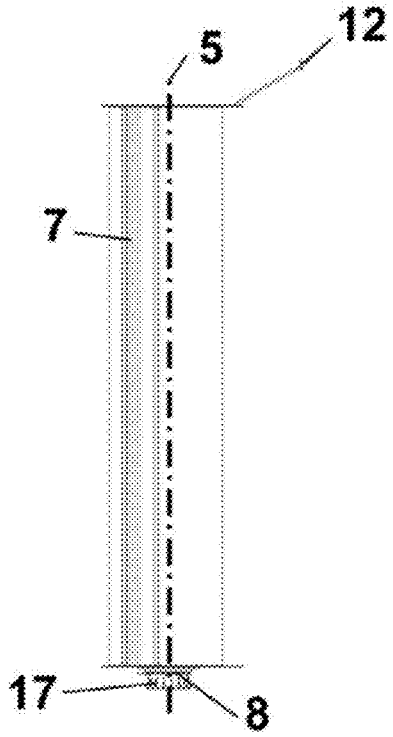
FIG. 2 is a side elevation view of a suction sail used in the propulsion system according to the present invention.
Figure 3:
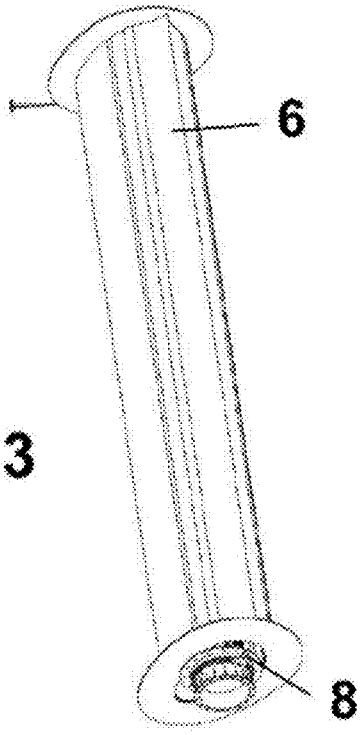
FIG. 3 is a perspective view seen from below of a suction sail used in the propulsion system in accordance with the present invention.
Figure 4:
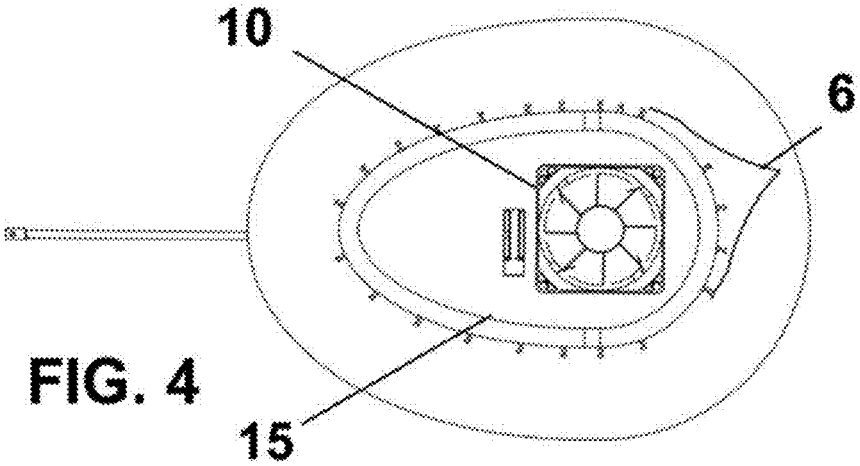
FIG. 4 is an upper view of a suction sail used in the propulsion system according to the present invention, in which the suction system is shown.
Figure 5:
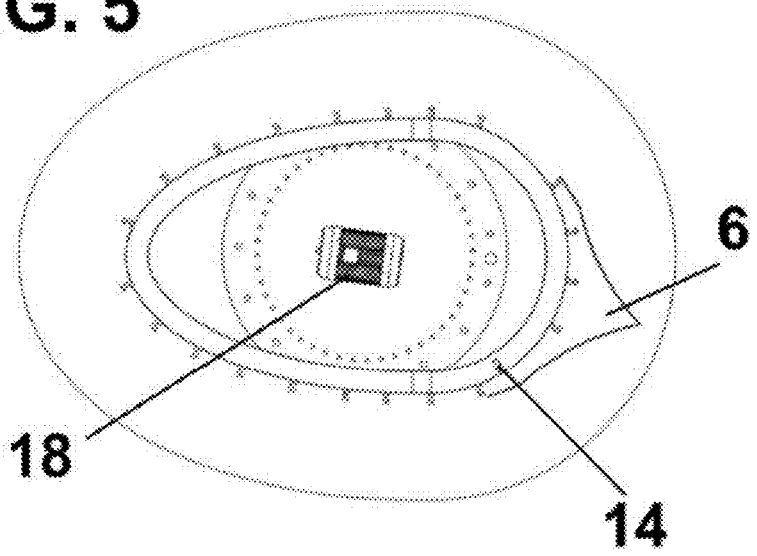
FIG. 5 is a sectional view of a suction sail used in the propulsion system according to the present invention, in which the driving unit and the power unit are shown.

FIG. 1 shows a vessel 2 comprising the propulsion system according to the present invention.

The propulsion system comprises at least one suction sail 3 including an outer coating 4, which may be either rigid or flexible, and said suction sail 3 may be rotated about its longitudinal axis 5.

The suction sail 3 also comprises at least one flap 6 capable of rotating between different positions and at least two suction zones 7 provided with multiple holes.

The suction sail 3 also comprises a suction system 10, which may be of the fan type or equivalent to suck part of the airflow from the extrados of the profile, and at least one driving unit 8, which may be electric or hydraulic to rotate the suction sail 3 provided with an electric or hydraulic power unit 18, which drives the driving unit 8.

In addition, the suction sail 3 is connected to the deck of the vessel 2 using a support structure 17, which may comprise a gear mechanism or a structure with bearings, where the support structure 17 is capable of supporting the total weight and restricting the lateral movement of the suction sail 3.

Figure 6:
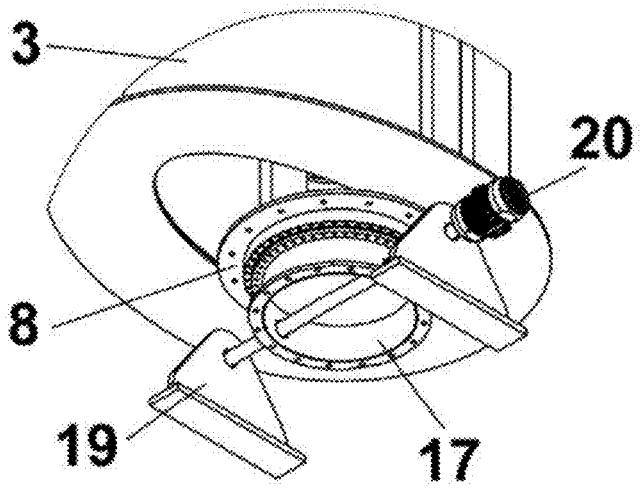
FIG. 6 is a view of the bottom of a suction sail used in the propulsion system of the present invention, according to an alternative embodiment, in which the suction sail is tilted with respect to a substantially horizontal axis.

In FIG. 6 an alternative embodiment has been shown, in which the lower part of the suction sail 3 comprises a tilting support 19, which allows the suction sail to be tilted with respect to the vertical, i.e. it is tilted with respect to a substantially horizontal axis, by driving a motor 20.

Figure 7:
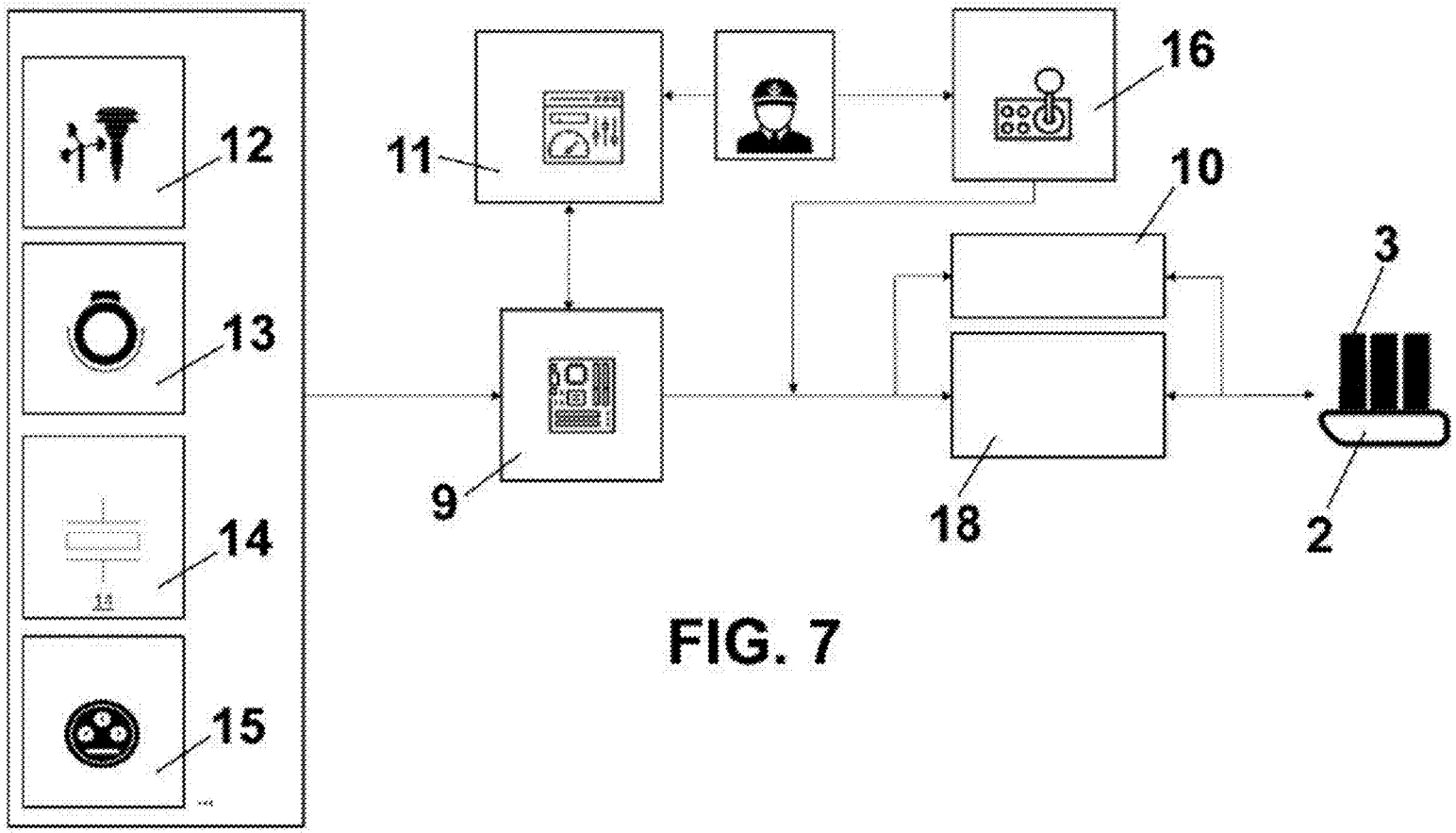
FIG. 7 is a block diagram of the components forming the propulsion system according to the present invention.

As can be seen from the block diagram in FIG. 7, the propulsion system according to the present invention also comprises a control unit 9 for controlling autonomously the driving unit 8 and the suction system 10 from information received from a plurality of sensors 12, 13, 14, 15, or manually, by means of a manual control unit 16, as will be described below.

For this purpose, the control unit 9 is accessible to users to adjust the autonomous or manual modes of the effective propulsion provided by the suction sail 3.

As indicated, the propulsion system according to the present invention comprises a plurality of sensors, which are chosen from the following:

- a wind sensor 12 for measuring the wind speed and direction, such as an anemometer to measure the speed and a weathervane to measure the direction, and/or an inertial sensor/tilt meter to measure the vessel tilt,

- a rotation sensor 13 to know in real time the angular position of the suction sail 3 in relation to the longitudinal axis 5 of the vessel 2,
- a position sensor 14 to know the position of the flap 6 between its possible operating positions, and
- a suction sensor 15, which detects the power and/or pressure to know the suction power provided by the suction system 10 by sucking through the holes of the suction zones 7 to create the corresponding pressure differential between the internal and external zone of the suction sail 3.

The control unit also comprises:

a data collection system;

a processor;

an autonomous control logic;

a driving system that sends a driving signal to the power unit and the suction system;

a control/supervision man-machine interface, i.e. a control communication system for introduction to the autonomous control and monitoring of the results obtained;

a man-machine interface for manual piloting.

The data collection system, formed by these sensors 12, 13, 14, 15, allows the monitoring of environmental variables, such as wind, air pressure, temperature and humidity), operating variables (rotation speed, internal pressure, flow direction).

The control unit also allows the monitoring of variables of a reference system (the vessel), such as speed, position, inertial unit and characterization of the propulsion unit (revolutions, flow, torque and propulsion force).

The control unit 9, where all the data are received and processed to obtain the optimal control solution, is also in charge of generating a system health indicator for predictive maintenance.

Examples of the use of the propulsion system disclosed in this document are described below.

A suction sail is able to generate high lift coefficients (aerodynamic forces) by sucking a certain amount of air from the boundary layer (the area of air near the surface of the sail) of the extrados (top/front side of the sail) which prevents the airflow from being detached and the profile from stall (a situation in which it no longer produces lift). This suction is done through one or more suction zones, generating a depression inside the sail that absorbs the air from the outside.

The size of the boundary layer, and therefore the amount of air to be drawn in, is a function of the Reynolds number (Re):

$$Re = \frac{\rho V L}{\mu}$$

Reynolds' number depends on:

The air speed (V).

The density of the air (ρ), which in turn depends on the pressure ($P_\infty$) and the temperature (T) of the air.

The dynamic viscosity of the air (μ), which in turn depends on the temperature (T) of the air.

If less of the required boundary layer is sucked in, this will result in the detachment of the boundary layer. If more boundary layer is sucked in, the excess is sucked in and thus consumes unnecessary suction power.

In order to be able to operate the suction sail efficiently and optimally, avoiding unwanted detachment and excessive power consumption, there must be precise control of the amount of air in the boundary layer to be suctioned, which is variable, as we have seen, with the speed, temperature and air pressure of each moment.

The control variable for this is the so-called Suction Pressure Coefficient (SPC), which is defined as $$C_{pa} = \frac{P_\infty - P_a}{1/2\rho V}$$

Where:

$P_\infty$—is the outside ambient pressure $P_a$—is the suction pressure, or internal pressure of the sail The principle of the control logic is to control the vacuum motor to achieve the necessary $P_a$ to obtain the desired $C_{pa}$ (design) for all operating conditions.

Figure 8:
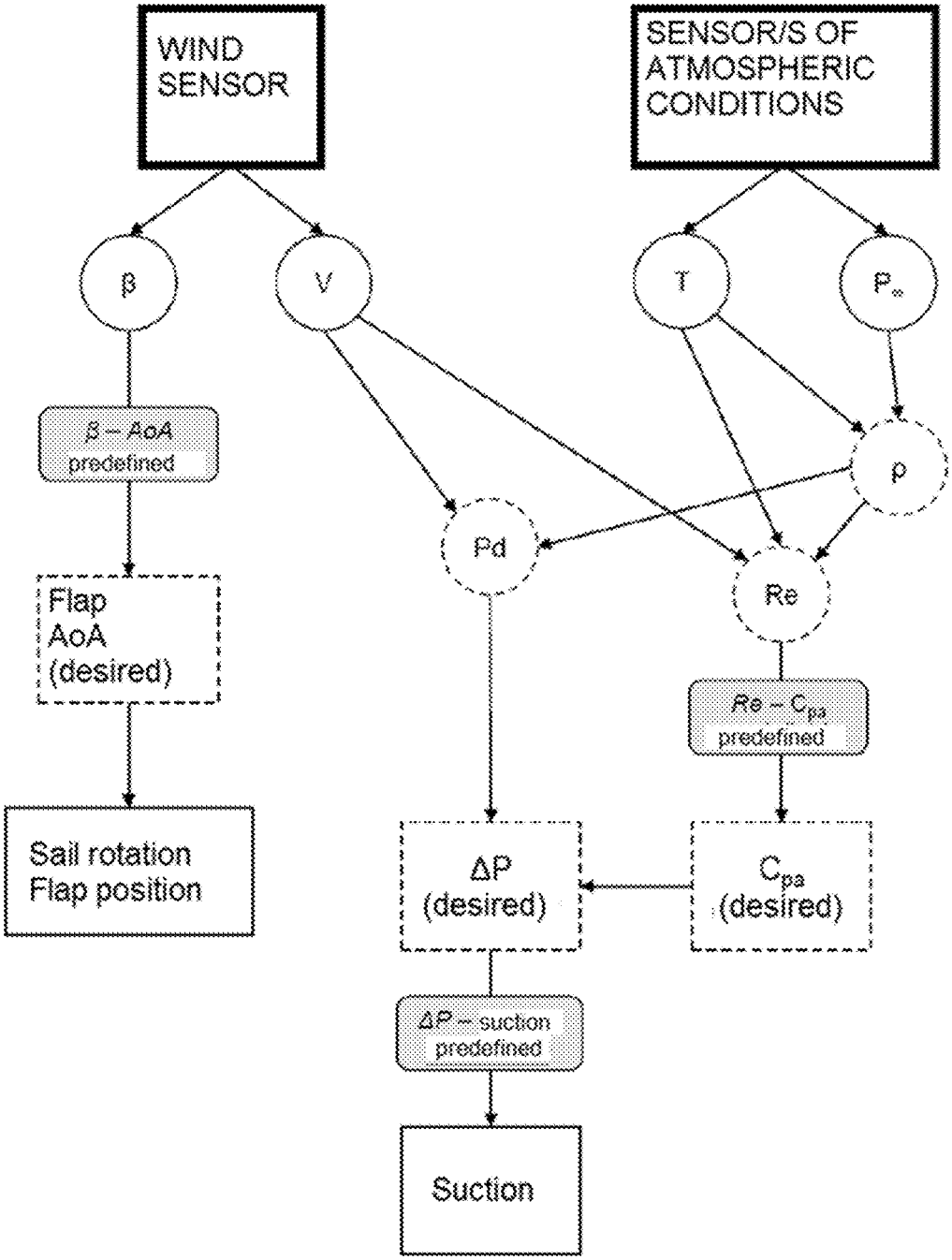
FIGS. 8 to 13 are diagrams showing different methods of control of the propulsion system according to the present invention.

Control Option 1:

This first autonomous control option, shown in FIG. 8, is based on the use of two groups of sensors:

- Sensors for measuring wind, in particular its speed (V) and direction with respect to the bow of the ship (β).
- Sensors for measuring environmental/atmospheric conditions, in particular temperature (T) and pressure ($P_\infty$).

To control the rotation of the sail and the position of the flap, the control system follows the following steps:

- Take the wind direction reading (β).
- That wind direction (β) has an associated attack angle (AoA) of the desired/target sail and a desired/target flap position. This relationship β-AoA is predefined (e.g. tabulated) in the system according to the sail design and control logic.
- The control system will act on the actuators for the rotation of the sail and the positioning of the flap to, by reading the different rotation and position sensors, bring it to the new desired position.

For suction control, the control system follows the following steps:

- It takes the reading of wind speed (V), temperature (T) and pressure ($\rho_\infty$).
- Density (ρ), dynamic pressure ($P_D$) and Reynolds number (Re) are calculated.
- This Reynolds number (Re) is associated with a desired/target suction pressure coefficient ($C_{pa}$). This Re-$C_{pa}$ ratio is predefined (e.g. tabulated) in the system according to the design of the sail and the control logic.
- The desired pressure increase (ΔP) is calculated. The operating curves of the suction system define the operating conditions (e.g. rpm, power . . . ) that provide a certain ΔP.
- The control system will act on the suction actuator to make it operate (e.g. rpm, power . . . ) under the conditions that generate that desired ΔP. That ΔP-suction (rpm, power . . . ) ratio is predefined (e.g. tabulated) in the system according to the design of the sail and the control logic.

Figure 9:
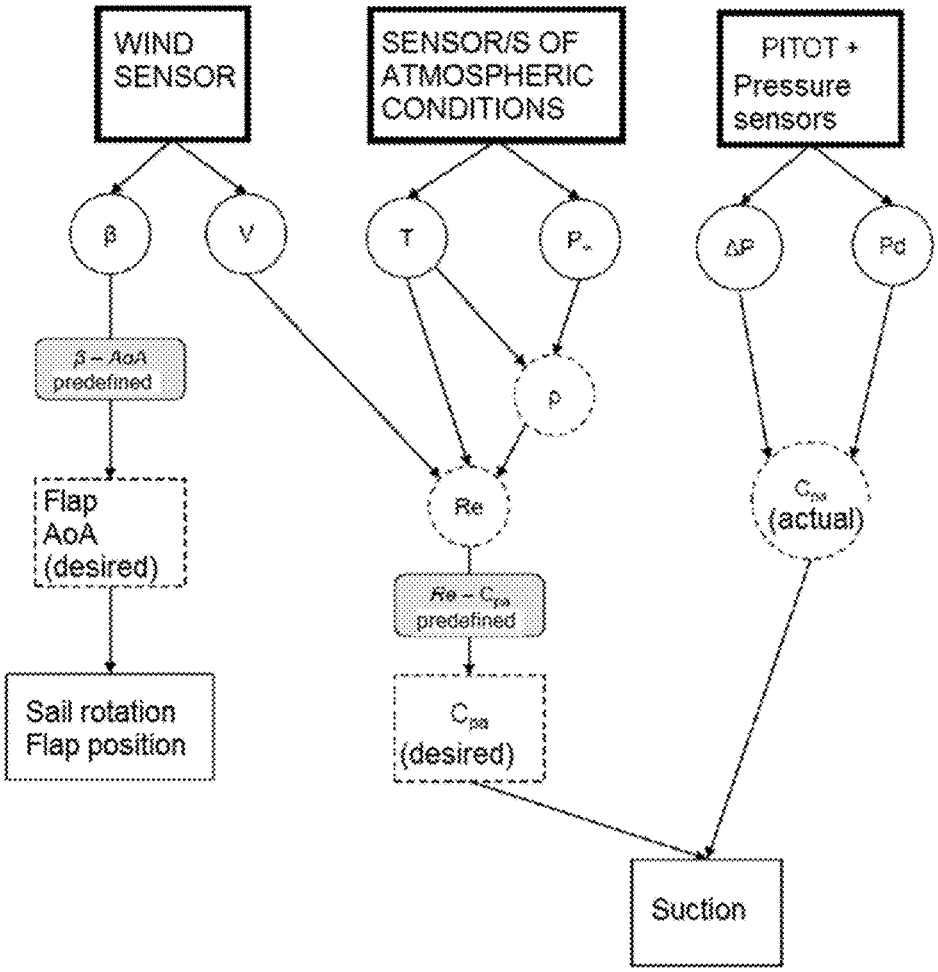

Control Option 2:

This second autonomous control option, shown in FIG. 9, is based on the use of three groups of sensors:

- Sensors for measuring wind, in particular its speed (V) and direction with respect to the bow of the vessel (β).
- Sensors for measuring environmental/atmospheric conditions, in particular temperature (T) and pressure ($P_\infty$).
- A Pitot tube equipped with pressure sensors. One of these pressure sensors measures the dynamic pressure ($P_d$). The others measure the differential pressure between the suction pressure ($P_a$) and the static pressure ($P_\infty$), thus obtaining the pressure increase (ΔP) between the inside and outside of the vessel. The existence of one or more pressure sensors allows to divide the measurement range in smaller sub-ranges, adjusting each sensor to that sub-range and thus, improving the measurement accuracy.

To control the rotation of the sail and the position of the wing, the control system follows the following steps:

Take the wind direction reading (β).

That wind direction (β) has an associated attack angle (AoA) of the desired/target sail and a desired/target flap position. This relationship β-AoA is predefined (e.g. tabulated) in the system according to the sail design and control logic.

The control system will act on the actuators for the rotation of the sail and the positioning of the flap to, by reading the different rotation and position sensors, bring it to the new desired position.

For suction control, the control system follows the following steps:

It takes the reading of wind speed (V), temperature (T) and pressure ($P_\infty$).

The density (ρ) and the Reynolds number (Re) are calculated.

This Reynolds number (Re) is associated with a desired/target suction pressure coefficient ($C_{pa}$). This Re-$C_{pa}$ ratio is predefined (e.g. tabulated) in the system according to the design of the sail and the control logic.

It takes the dynamic pressure ($P_d$) and pressure increase reading (ΔP) measured by the Pitot tube and pressure sensor assembly.

The actual suction pressure coefficient ($C_{pa}$) is calculated.

The control system will act on the suction actuator (e.g. rpm, power . . . ) to adjust the actual $C_{pa}$ to the desired/target $C_{pa}$.

Figure 10:
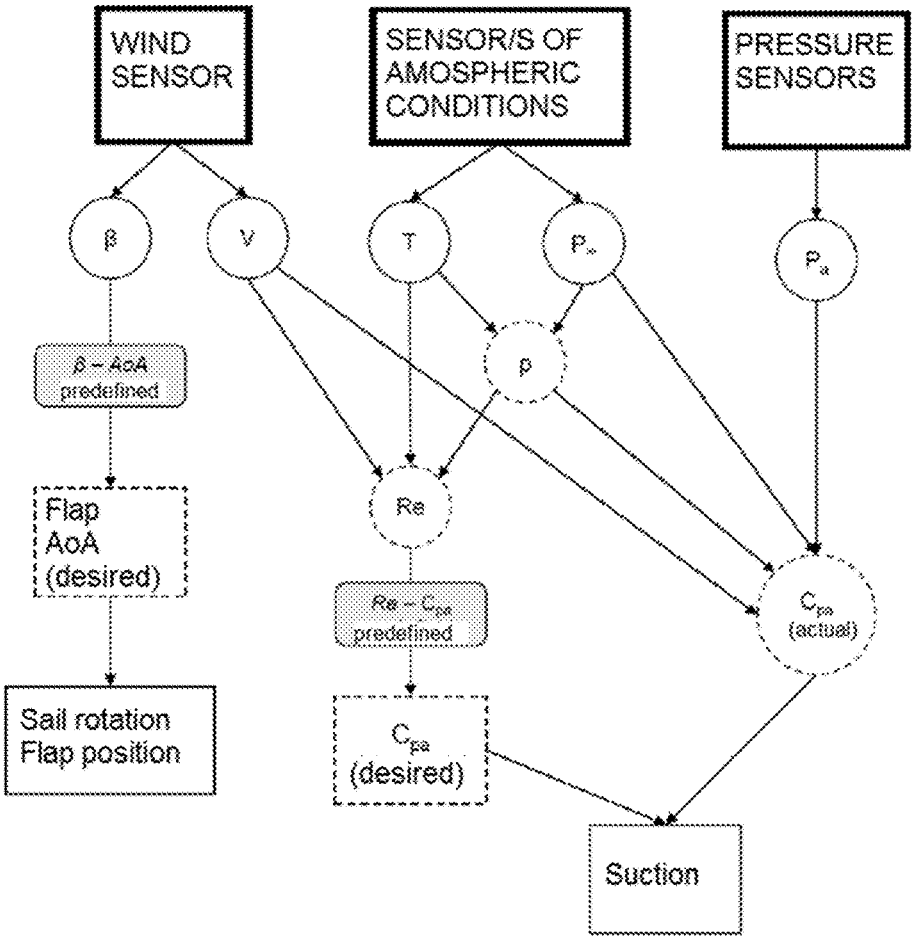

Control Option 3:

This third autonomous control option, shown in FIG. 10, is based on the use of three groups of sensors:

Sensors for measuring wind, in particular its speed (V) and direction with respect to the bow of the vessel (β).

Sensors for measuring environmental/atmospheric conditions, in particular temperature (T) and pressure ($P_\infty$).

Various pressure sensors measure the suction pressure ($P_a$). The existence of one or more pressure sensors allows to divide the measurement range into smaller sub-ranges, adjusting each sensor to that sub-range and thus improving the measurement accuracy.

To control the rotation of the sail and the position of the flap, the control system follows the following steps:

Take the wind direction reading (β).

That wind direction (β) has an associated attack angle (AoA) of the desired/target sail and a desired/target wing position. This relationship β-AoA is predefined (e.g. tabulated) in the system according to the sail design and control logic.

The control system will act on the actuators for the rotation of the sail and the positioning of the flap to, by reading the different rotation and position sensors, bring it to the new desired position.

For suction control, the control system follows the following steps:

It takes the reading of wind speed (V), temperature (T) and pressure ($P_\infty$).

The density (ρ) and the Reynolds number (Re) are calculated.

This Reynolds number (Re) is associated with a desired/target suction pressure coefficient ($C_{pa}$). This Re-$C_{pa}$ ratio is predefined (e.g. tabulated) in the system according to the design of the sail and the control logic.

It takes the pressure reading ($P_\infty$), the suction pressure ($P_a$), the wind speed (V) and the calculated density (ρ).

The actual suction pressure coefficient ($C_{pa}$) is calculated.

The control system will act on the suction actuator (e.g. rpm, power . . . ) to adjust the actual $C_{pa}$ to the desired/target $C_{pa}$.

Figure 11:
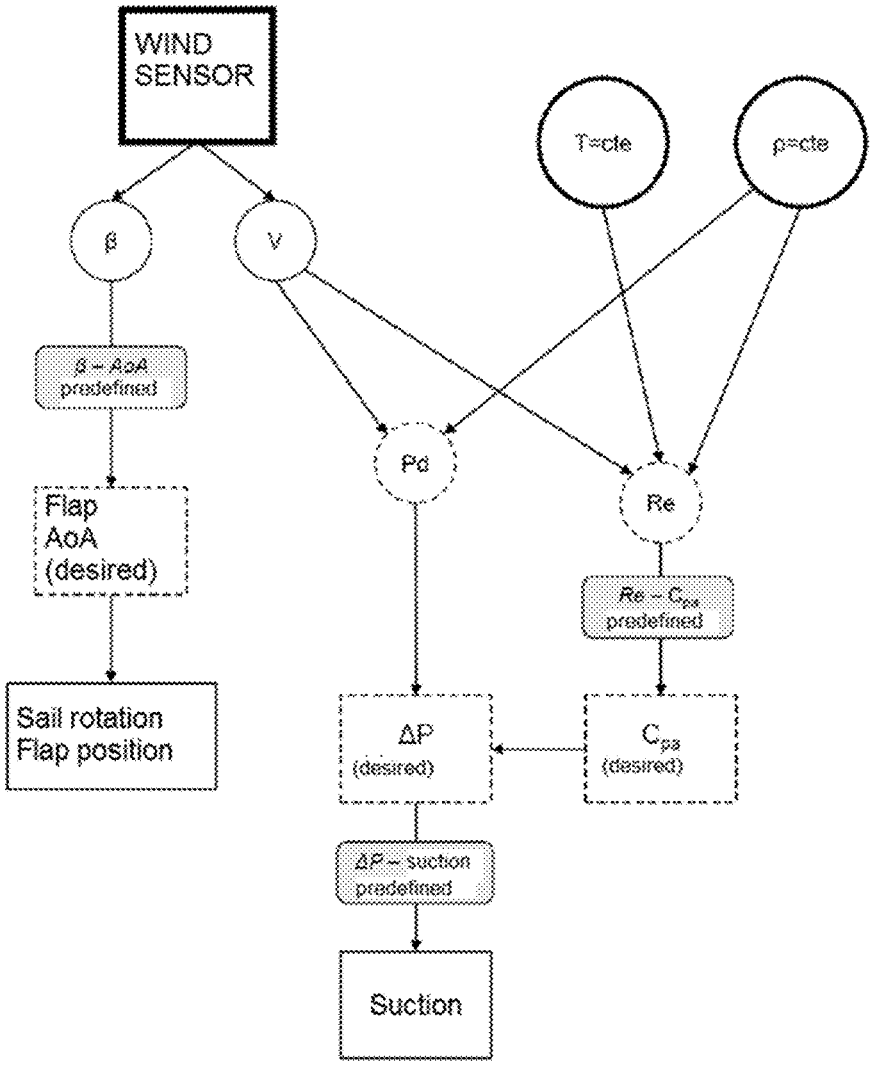

Simplified Control Option:

There is a simplification option of the control methodology, shown in FIG. 11, applicable to the 3 options described above, which consists of eliminating the measurement of the atmospheric conditions of temperature (T) and pressure ($P_\infty$), and taking a predefined constant value for temperature (T) and density (ρ).

This simplifies the system architecture and data collection and processing. In return, an error is introduced in the determination of the desired/target suction coefficient ($C_{pa}$), desired/target pressure increase (ΔP) and/or in the actual suction coefficient ($C_{pa}$) (depending on the control option applied), which introduces error in the suction precision, leading to a sub-optimal operation.

An intermediate option could also be the use of the ISA (International Standard Atmosphere) equations that allow relating the environmental variables of Temperature, Pressure and Density. Thus, by measuring only one of the three variables with a sensor, the other two can be calculated.

As an example, the steps followed by the control system, according to option 1, for the suction control are detailed:

Temperature (T) and density (p) values are predefined.

Take the wind speed reading (V).

The dynamic pressure ($P_D$) and Reynolds number (Re) are calculated, which now only depend/change with the wind speed reading.

This Reynolds number (Re) is associated with a desired/target suction pressure coefficient ($C_{pa}$). This Re-$C_{pa}$ ratio is predefined (e.g. tabulated) in the system according to the design of the sail and the control logic.

The desired pressure increase (ΔP) is calculated. The operating curves of the suction system define the operating conditions (e.g. rpm, power . . . ) that provide a certain ΔP.

The control system will act on the suction actuator to make it operate (e.g. rpm, power . . . ) under the conditions that generate that desired ΔP That ΔP-suction (rpm, power . . . ) ratio is predefined (e.g. tabulated) in the system according to the design of the sail and the control logic.

Control Option 4

Figure 13:
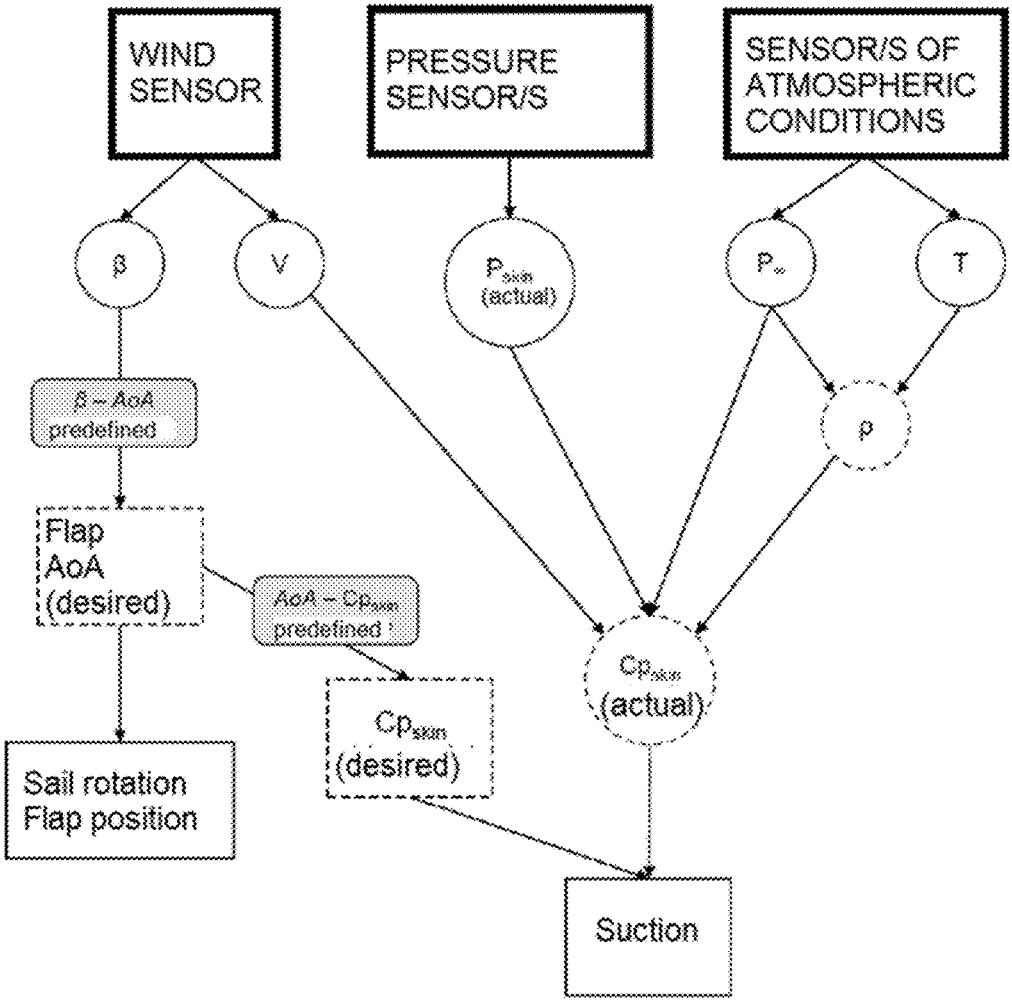

For this alternative method of control, shown in FIG. 13, the theoretical basis and principles of the control logic of sail rotation and flap position are identical to those detailed for the other 3 control methods.

Any aerodynamic profile exposed to an airflow generates a pressure distribution ($P_{skin}$), along its surface. The difference between that pressure distribution on both sides of the profile is what generates the profile aerodynamic forces, i.e. lift and drag.

If that surface pressure ($P_{skin}$) is dimensioned, it is converted to the pressure coefficient ($C_P$), where the pressure coefficient is defined as:

$$C_p = \frac{P_\infty - P_{skin}}{1/2\rho_\infty V_\infty}$$

The distribution (its shape and values) becomes dependent only on the attack angle (AoA). At the same time, the lift coefficient ($C_L$) also depends only on the attack angle (AoA), so the surface pressure coefficient of a point ($C_P$) can be linked unequivocally to the lift coefficient ($C_L$) that is giving the profile.

Figure 12:
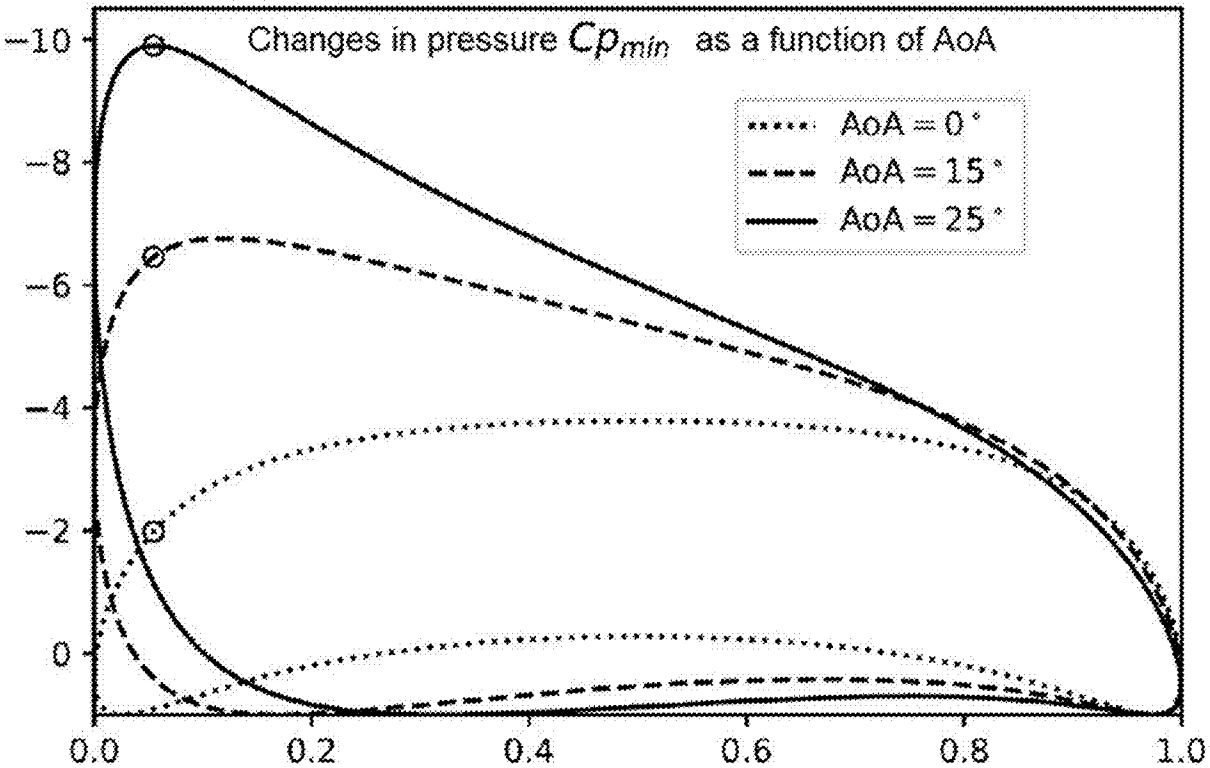

By extrapolating this to a suction sail, given a known AoA, we know what the surface pressure coefficient ($C_P$) should be at a given point if the suction is adequate. If it is lower, it is an indication that the profile is stall due to inadequate suction. This difference in $C_P$ occurs at any point along the profile chord, although it is preferable to choose a point where the pressure variations are more marked, to simplify detection, this point being in proximity to the profile leading edge. This variation of surface pressure coefficient ($C_P$) for various angles of attack (AoA) can be seen in FIG. 12.

The principle of the control logic is to control the vacuum motor to achieve a measured $C_P$ equal to the desired (design) $C_P$ for all operating conditions.

This autonomous control option, shown in FIG. 13, is based on the use of three groups of sensors:

Sensors for measuring wind, in particular its speed (V) and direction with respect to the bow of the vessel (β).

Sensors for measuring environmental/atmospheric conditions, in particular temperature (T) and pressure ($P_\infty$).

Various pressure sensors measure the surface pressure ($P_{skin}$) at one or more skin, relevant points on the sail surface. The existence of one or more pressure sensors allows to divide the range of measurements in smaller sub-ranges, adjusting each sensor to that sub-range and thus improving the accuracy of the measurement.

To control the rotation of the sail and the position of the flap, the control system follows the following steps:

Take the wind direction reading (β).

This wind direction (β) is associated with a desired/target attack angle (AoA) of the sail and a desired/target flap position predefined in the system according to the sail design.

The control system will act on the actuators for the rotation of the wing and the positioning of the flap to, by reading the different rotation and position sensors, bring it to the new desired position.

For suction control, the control system follows the following steps:

Take the temperature (T) and pressure reading ($P_\infty$).

Density is calculated (ρ).

It takes the reading of wind speed (V), pressure ($P_\infty$) and surface pressure ($P_{skin}$), along with the calculated density (ρ).

The surface pressure coefficient ($C_{Pskin}$) is calculated.

Take the wind direction reading (β).

This wind direction (β) is associated with a desired/target attack angle (AoA) of the sail and a desired/target flap position predefined in the system according to the sail design.

That attack angle (AoA) is associated with a desired target surface pressure coefficient ($C_{Pskin}$).

The control system will act on the suction actuator (e.g. rpm, power . . . ) to adjust the actual $C_{Pskin}$ to the desired/target $C_{Pskin}$.

Despite the fact that reference has been made to specific embodiments of the invention, it is clear to a person skilled in the art that the described propulsion system is susceptible to numerous variations and modifications, and that all the details mentioned can be replaced by other technically equivalent ones, without deviating from the scope of protection defined by the attached claims.

The invention claimed is:

1. A propulsion system for vessels comprising:

at least one suction sail, each suction sail comprising a suction system, a flap, and a driving unit for driving operation of the at least one suction sail;

wherein the at least one suction sail further comprises a plurality of sensors connected to a control unit for operation of the suction system, the flap, and the driving unit;

wherein said plurality of sensors comprises at least one rotation sensor and at least one suction sensor;

wherein the flap is rotatable between different positions; and wherein said plurality of sensors further comprises at least one position sensor of the flap.

2. The propulsion system for vessels according to claim 1, wherein said plurality of sensors further comprises at least one wind sensor.

3. The propulsion system for vessels according to claim 1, wherein said control unit comprises a user interface.

4. The propulsion system for vessels according to claim 1, wherein the propulsion system also comprises a manual control unit connected to said suction system and to said driving unit.

5. The propulsion system for vessels according to claim 1, wherein said suction sail comprises a rigid or flexible outer coating.

6. The propulsion system for vessels according to claim 1, wherein said suction sail comprises two or more suction areas provided with a plurality of holes.

7. The propulsion system for vessels according to claim 1, wherein said driving unit is located at the lower end of the suction sail.

8. The propulsion system for vessels according to claim 1, wherein said driving unit is an electric or hydraulic driving unit, powered by a power unit.

9. The propulsion system for vessels according to claim 1, wherein the suction sail comprises a support structure at its lower end.

10. The propulsion system for vessels according to claim 1, wherein the lower part of the suction sail comprises a tilting support, causing the suction sail to tilt about a substantially horizontal axis.

* * * * *